US005338904A

United States Patent [19]

Powell et al.

[11] Patent Number: 5,338,904

[45] Date of Patent: Aug. 16, 1994

[54] EARLY CAR ANNOUNCEMENT

[75] Inventors: Bruce A. Powell, Canton; David J. Sirag, Jr., South Windsor, both of Conn.

[73] Assignee: Otis Elevator Company, Farmington, Conn.

[21] Appl. No.: 128,931

[22] Filed: Sep. 29, 1993

[51] Int. Cl.[5] ..... B66B 3/00; B66B 1/18

[52] U.S. Cl. ..... 187/137; 187/127; 187/121

[58] Field of Search ..... 187/137, 135, 127, 121, 187/124, 130

[56] References Cited

U.S. PATENT DOCUMENTS

| | | | |
|---|---|---|---|
| 4,793,443 | 12/1988 | MacDonald et al. | 187/127 |
| 5,092,431 | 3/1992 | Schroder | 187/127 |
| 5,146,053 | 9/1992 | Powell et al. | 187/127 |
| 5,239,142 | 8/1993 | Ekholm et al. | 187/127 |
| 5,271,484 | 12/1993 | Bajat et al. | 187/29.1 |

FOREIGN PATENT DOCUMENTS

| | | | |
|---|---|---|---|
| 0508438 | 10/1992 | European Pat. Off. | 187/137 |

*Primary Examiner*—Steven L. Stephan
*Assistant Examiner*—Robert Nappi
*Attorney, Agent, or Firm*—Breffni Xavier Baggot

[57] ABSTRACT

In response to a registered hall call, a car announcement is made when and only when an assigned car, of a plurality, has its RRT a calculated number of seconds lower than the car with the next lowest RRT to minimize actual waiting time wherein the calculation is performed as a function of the remaining response time of the assigned car, the waiting time of the passenger, and an RRT inflation factor which is an amount of deviation from the minimum expected remaining response time of the assigned car.

3 Claims, 13 Drawing Sheets

Car D is chosen by the dispatcher as the best car.

$$\Delta_D = \left(\frac{0+4}{0+1}\right)^2 \times 4 \times 15^2 \times 0.5$$

$$= 7{,}200$$

$$RRT_D + \Delta_D \overset{?}{\leq} \min\{RRT_B, RRT_C\}$$

$$4 + 7{,}200 \overset{?}{\leq} \min\{100000, 10\}$$

NO...ASSIGN HALL CALL TO CAR D, BUT DO NOT ANNOUNCE.

Car D is chosen by the dispatcher as the best car.

$$\Delta_D = \left(\frac{1+3}{2+1}\right)^2 \times 3 \times 14^2 \times 0.5$$

$$= 523$$

$$RRT_D + \Delta_D \overset{?}{\leq} \min\{RRT_B, RRT_C\}$$

$$3 + 523 \overset{?}{\leq} \min\{100000, 18\}$$

NO...ASSIGN HALL CALL TO CAR D, BUT DO NOT ANNOUNCE.

Car C is chosen by the dispatcher as the best car.

$$\Delta_C = \left(\frac{10+9}{20+1}\right)^2 \times 9 \times 3^2 \times 0.5$$

$$= 33$$

$$RRT_C + \Delta_C \overset{?}{\leq} \min\{RRT_B, RRT_D\}$$

$$9 + 33 \overset{?}{\leq} \min\{63, 45\}$$

NO...ASSIGN HALL CALL TO CAR C, BUT DO NOT ANNOUNCE.

| STOP | 9 UP | 10 UP | 11 UP | 12 UP | 13 UP | 14 UP | 15 UP | 16 UP | 17 UP | 18 | 17 DN | 16 DN | 15 DN | 14 DN | 13 DN |
|---|---|---|---|---|---|---|---|---|---|---|---|---|---|---|---|
| INFLATION POINTS | 1 | 1 | 5 | 1 | 1 | 5 | 1 | 1 | 1 | 1 | 1 | 1 | 0 | 1 | 1 |

EARLY CAR ANNOUNCEMENT

TECHNICAL FIELD

The present invention relates to elevator dispatching, and in particular to the time for announcement to passengers waiting in the hallway of a car to serve a hall call.

BACKGROUND OF THE INVENTION

In response to a registered hall call, conventional elevator dispatching logic provides for audio or visual announcement of the assigned car in the hallway when the assigned car reaches a commitment point. The commitment point is defined as the location of the elevator at which it begins deceleration. The announcement is made no later than the commitment point because at that point the car must stop at the floor and there is not much advantage to delaying the announcement. In conventional logic, the announcement is made no sooner because an elevator dispatcher which controls the assignment of cars to hall calls uses the time between registration and announcement to make the best assignment. This announcement gives the passenger approximately two seconds notice before the car doors begin to open. An example of this conventional dispatching logic is the RSR scheme in "Relative System Response Elevator Call Assignments", U.S. Pat. No. 4,815,568.

A drawback of RSR is that while waiting for an elevator, a passenger naturally becomes anxious about which car will arrive, and the level of anxiety increases as the waiting time grows. This level of anxiety could be greatly reduced.

The Japanese elevator market requires the announcement of the car as soon as the waiting passenger registers his/her hall call. This feature is commonly referred to as ICA, or Instantaneous Car Assignment.

The problem with ICA is that often a car which appears to be an excellent candidate for a first assignment when the hall call is registered can become delayed by its assignment to hall calls and car calls entered after the first assignment. This can lead to a call that waits a very long time, which is more than 60 seconds. Assignment of the hall call, for example, may be to the car with the shortest Remaining Response Time (RRT). RRT is an estimation of the amount of time required for an elevator to reach the commitment point of the floor at which the hall call is registered, given the car calls and hall calls to which the elevator car is committed. Alternatively, Remaining Response Time may be defined as an estimation of the amount of time required for an elevator to reach the floor at which the hall call is registered, given the car calls and hall calls to which the elevator car is committed.

FIGS. 1–3 illustrate this problem. A group of six elevators serve 18 floors. As shown in FIG. 1, a down hall call was registered by a new passenger at Floor 12. The RRT for each car relative to this new hall car is shown above or below the car. The call becomes assigned to Car 3 because its RRT (Remaining Response Time) was lower than the other cars. Because the ICA feature is in effect, the assignment process is not repeated to determine if any assignment other than the initial one might be better.

At the time of the snapshot of the system in FIG. 1, car #3 had just cancelled an UP hall call on Floor 12 and was opening its doors at the moment when the new passenger registered the down hall call on Floor 12. An up-traveling passenger enters the car at Floor 12.

Because the up-traveling passenger had not yet registered the car call, the RRT for Car 3 relative to the new down hall call was only five seconds. Car 5 is loading new passengers on floor 16. It has an assigned hall call on floor 15 and has an RRT of 21 seconds for the new down hall call.

FIG. 2 shows the system after the down hall call has been waiting for 32 seconds. Instead of cancelling the assigned down hall call on floor 12, the assigned car (Car 3) travels toward floor 18 to fulfill its car call. Because of ICA, the down hall call on floor 12 must wait for Car 3 to return. Car 5 has bypassed Floor 12, and Car 6 is about to bypass Floor 12. Also, Car 4 is empty and traveling toward Floor 14 to reverse and answer a down hall call.

FIG. 3 shows the system after the down hall call at Floor 12 has been waiting for 67 seconds. Car 4 has already bypassed Floor 12. In the meantime, Car 3 is moving toward Floor 12 but still must make a car call stop on Floor 13.

These figures show that car #3 was initially judged to be a good assignment because of the very small RRT. In hindsight, any of three other cars (Cars 6, 5, or 4) would have reached Floor 12 sooner.

DISCLOSURE OF THE INVENTION

Objects of the present invention include making an announcement as to which of a plurality of cars will serve a hall call almost as early as the instant of the hall registration, almost as late as when a car assigned to serve the hall call reaches the commitment point, or anywhere between.

The advantage is that, when the announcement occurs between the hall call registration and the commitment point, the frustration on the part of the waiting passenger is decreased because the passenger is not standing in one location—either standing in front of the elevator that will serve him or standing in the location he took after he entered the hall call and began to wonder which car will serve him. Rather he stands in one location for a short time awaiting the car announcement, moves toward the announced car and then stands in a second location awaiting the arrival of the car for a short time.

According to the present invention, in response to a registered hall call, a car announcement is made when and only when an assigned car, of a plurality, which is deemed to be the best of all cars has its RRT a calculated number of seconds lower than the car with the next lowest RRT to minimize actual waiting time wherein the calculation is performed as a function of the remaining response time of the assigned car, the waiting time of the passenger, and an RRT inflation factor which is an amount of deviation from the minimum expected remaining response time of the assigned car. This avoids premature assignments in which the initially assigned car later turns out to be a bad choice and at the same time reduces the perceived waiting time by generally breaking the wait into two roughly equal parts with the announcement.

Other objects, features, and advantages will become apparent in light of the text and drawings.

BEST MODE FOR CARRYING OUT THE INVENTION

Figure 4:
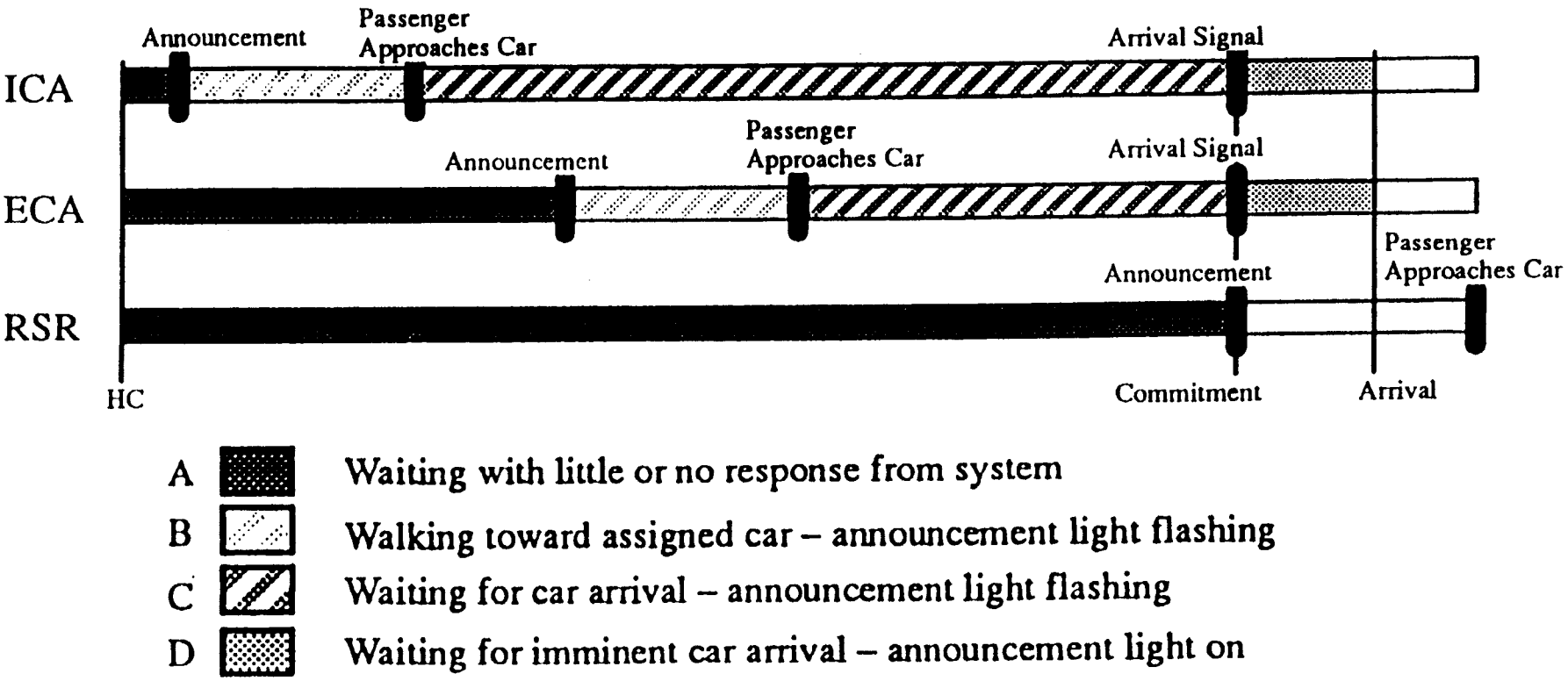
FIG. 4 shows the responses to a hall call of three different elevator dispatching routines in terms of: A) the time of announcement of the assigned car, B) the time that a passenger approaches the assigned car, C) the time announcement of car arrival, and D) time of car arrival.

FIG. 4 shows the responses to a hall call of three different elevator dispatching routines in terms of: A) time of announcement of the assigned car, B) time that a passenger approaches car, C) announcement of car arrival, and D) time of car arrival. The dispatching routines are ICA, ECA (the present invention) and RSR. The events in the time chart of FIG. 4 are dated from registration of a hall call (HC). The ICA routine follows hall call registration at the end of period A with an announcement as to which car will service the hall call. The passenger begins approaching the car announced as serving the registered hall call. After the passenger has reached the car, at the end of period B, he waits a (comparatively) long time until the an arrival signal announces by a hall lantern or gong that the car has almost arrived at his floor.

Under RSR, the passenger waits a (comparatively) long time before he learns which car will serve him. The announcement as to which car will serve the hall call comes at the commitment point at which the car must begin decelerating in order to be able to stop at the floor. Under RSR, there is no announcement signal prior to commitment point. RSR uses all of the time from the hall call registration to the commitment point for evaluating and reevaluating the car assignment.

Figure 1:
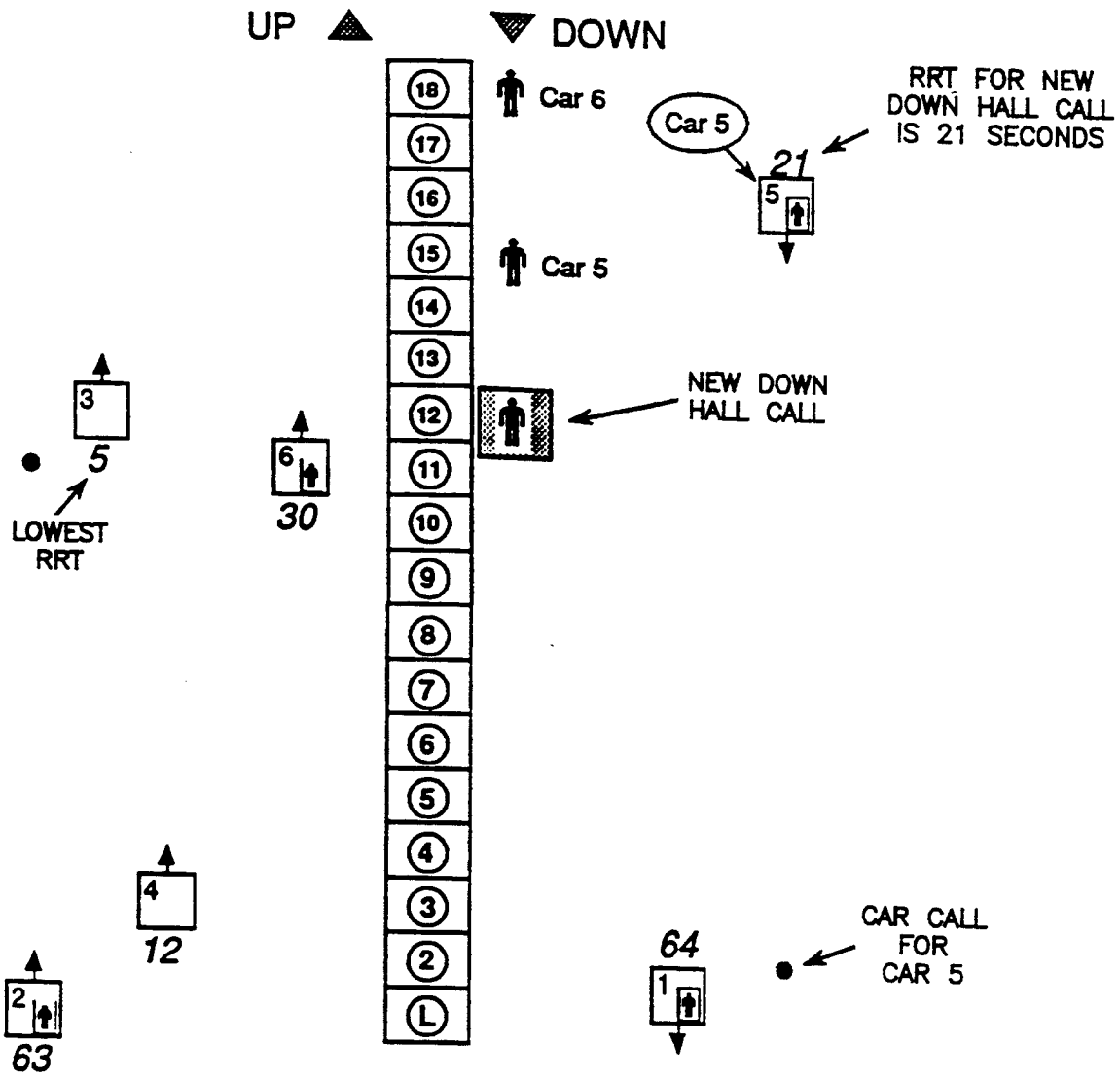
FIG. 1 is a snapshot in time of the state of the elevator system where car 3, having the lowest remaining response time, is assigned a new hall call on floor 12.
Figure 2:
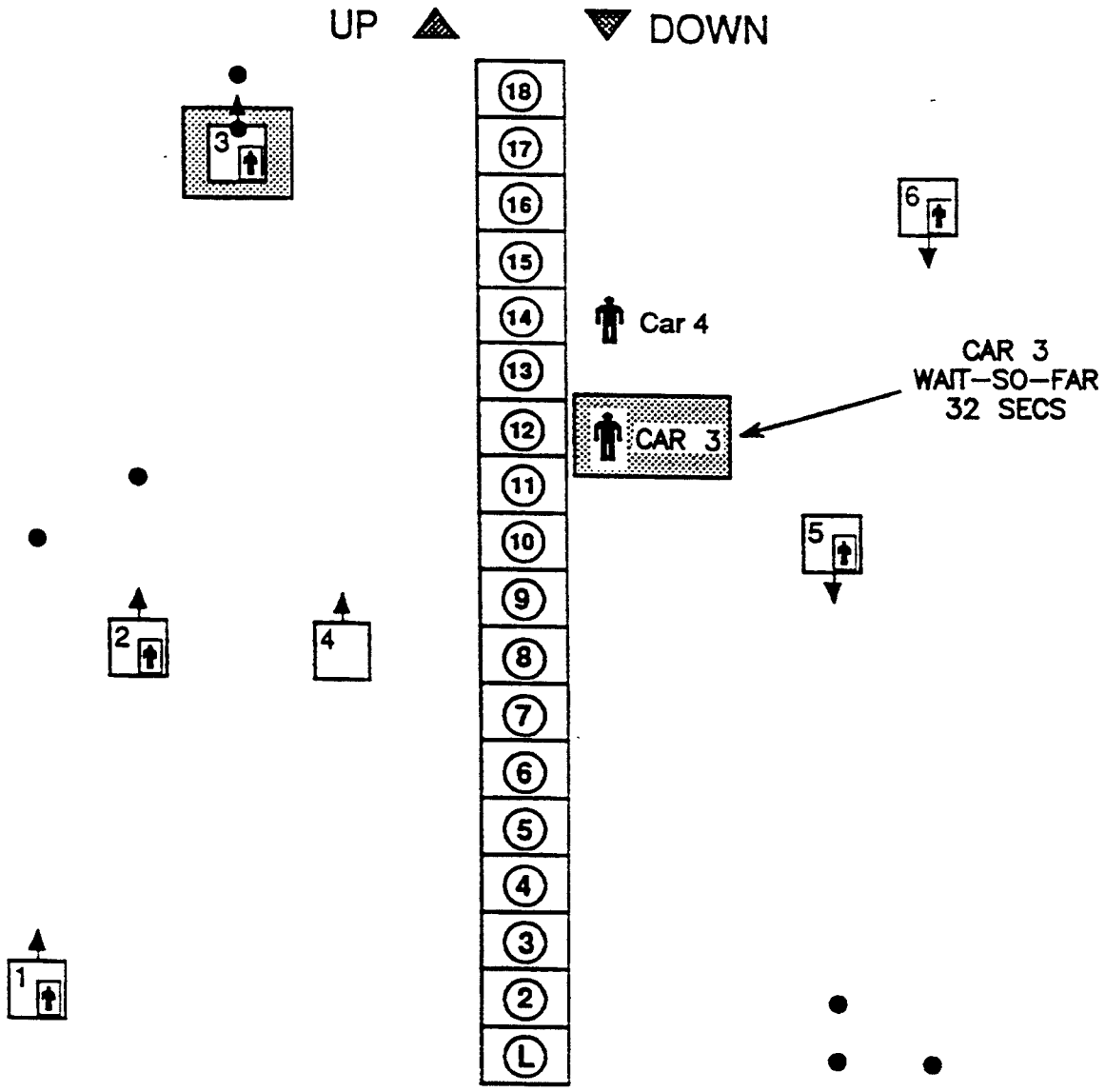
FIG. 2 is a snapshot in time of the state of the elevator system at a time later than that shown in FIG. 1; car 3 has not answered the call at floor 12.
Figure 3:
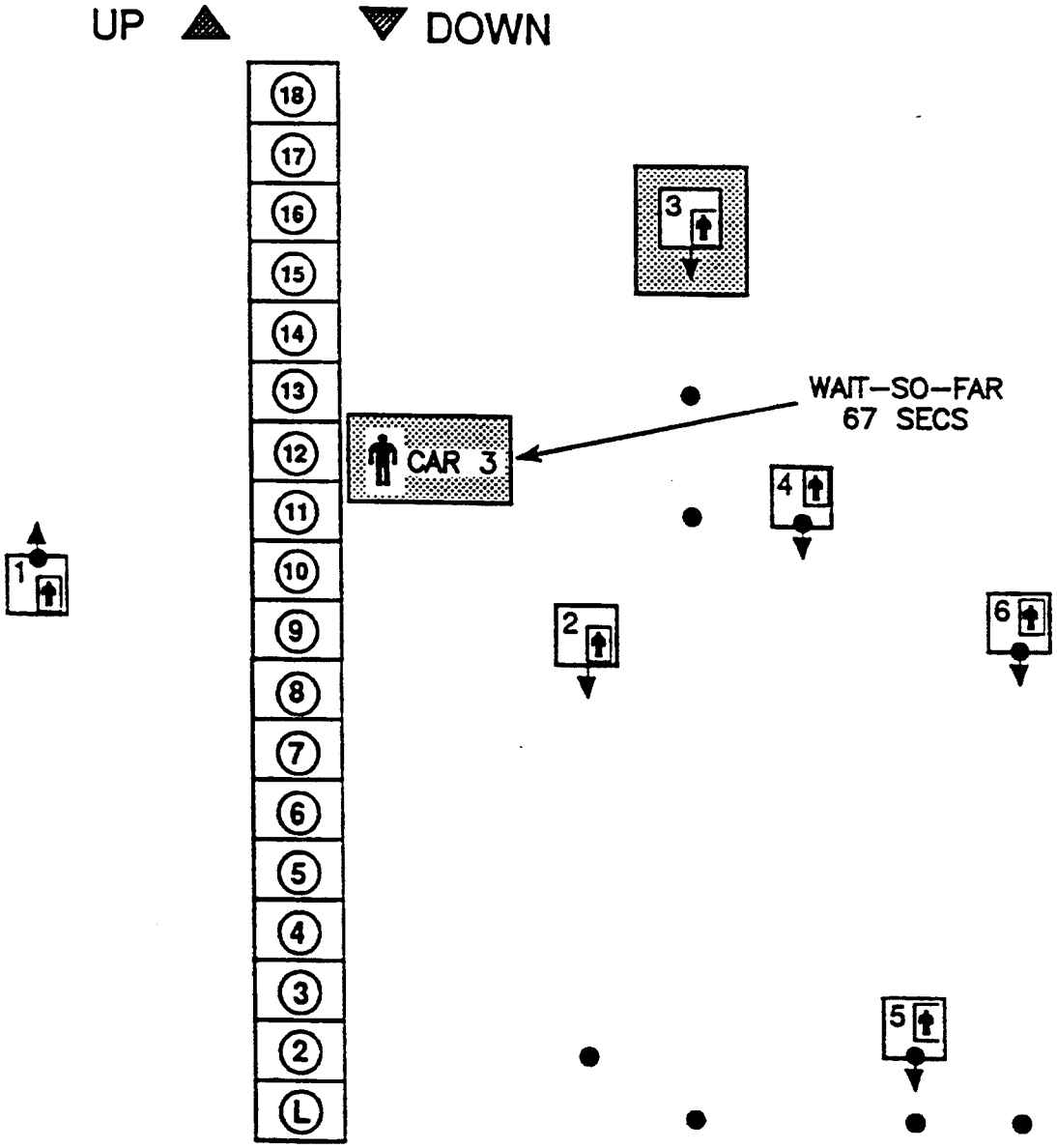
FIG. 3 is a snapshot in time of the state of the elevator system at a time later than that shown in FIG. 2; car 3 has still not answered the call at floor 12.

In this method of ECA, an RRT of each car i is compared with the worst case RRT of the best car for the assignment. Which car is best may be decided by any of a number of dispatching algorithms. The "worst case" RRT is calculated by adding a quantity, $\Delta_{best}$, proportional to the inflation of the RRT. The more cars with RRT's less than this "worst case" RRT, the more reasonable alternative cars there are that could be assigned to the hall call. (See FIG. 2).

A compromise between instantaneous announcement and "last moment", i.e., commitment point announcement, is desired. On the one hand, we wish to make the car announcement as early as possible. On the other hand, we want to be certain that the car, once it is committed to the hall call and that commitment is announced, will not be delayed by future events such as future unregistered hall calls and car calls.

The proposed implementation of ECA is this: Make a car announcement when and only when the best car has its RRT at least $\Delta_{best}$ seconds lower than the car with the next lowest RRT.

One form of the invention uses equations 1 and 2 below. $\Delta_{best}$ is fundamentally a function of time which approaches zero as the passenger waits because of an RRT factor.

$$\Delta_{best}(W, RRT, I) = \left(\frac{W + RRT}{2W + 1}\right)^2 (RRT)I^2A \tag{1}$$

where

W is the time waited so far

RRT is the current RRT

I is the RRT Inflation

A is a constant scaling factor.

The call should be announced when:

$$RRT_{best} + \Delta_{best}(W, RRT_{best}, I_{best}) < \underset{i \neq \text{best}}{\text{MIN}}[RRT_i] \tag{2}$$

where $RRT_{best}$ is the RRT of the best car for the assignment and $I_{best}$ is the corresponding RRT Inflation value for the car chosen as best by the prevailing car assignment logic. The rationale for equation 1 is as follows:

1)The term $$\left(\frac{W + RRt}{2W + 1}\right)^2$$

drops rapidly after the passenger has waited more than half of the expected wait time. The expected wait time is the time expected for the passenger to wait from hall call entry until the elevator arrives at the floor where the hall call was entered. Since this is a term of $\Delta_{best}$, $\Delta_{best}$ also drops to zero.

2) RRT forces $\Delta_{best}$ to drop to zero as the currently assigned car approaches the commitment point.

3) $I^2$ inhibits announcement for assignments with large RRT inflation (I). It is squared because it also has the basic role as the uncertainty factor in the RRT estimate. This uncertainty should affect the announcement and the final assignment. Prior art dispatching logic did not do this.

4) A is a constant scaling factor chosen to make this term compatible with RRT. Large values of A cause the system to make later announcements, while smaller values encourage earlier announcements.

Figure 5A:
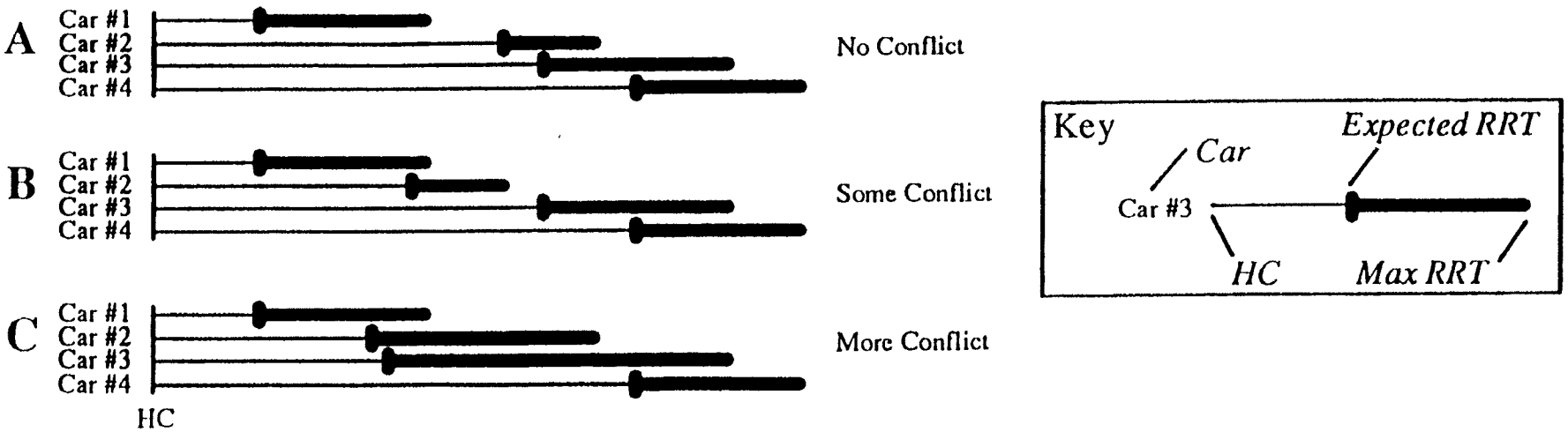
FIGS. 5*a* and 5*b* charts conflict between cars for service of a hall call as judged by overlap of expected remaining response times and maximum remaining response times.

FIG. 5*a* defines conditions of no conflict, some conflict and more conflict among cars for service of a hall call as judged by overlap of remaining response time(RRT) and maximum remaining response times (maxRRT).

Figure 6:
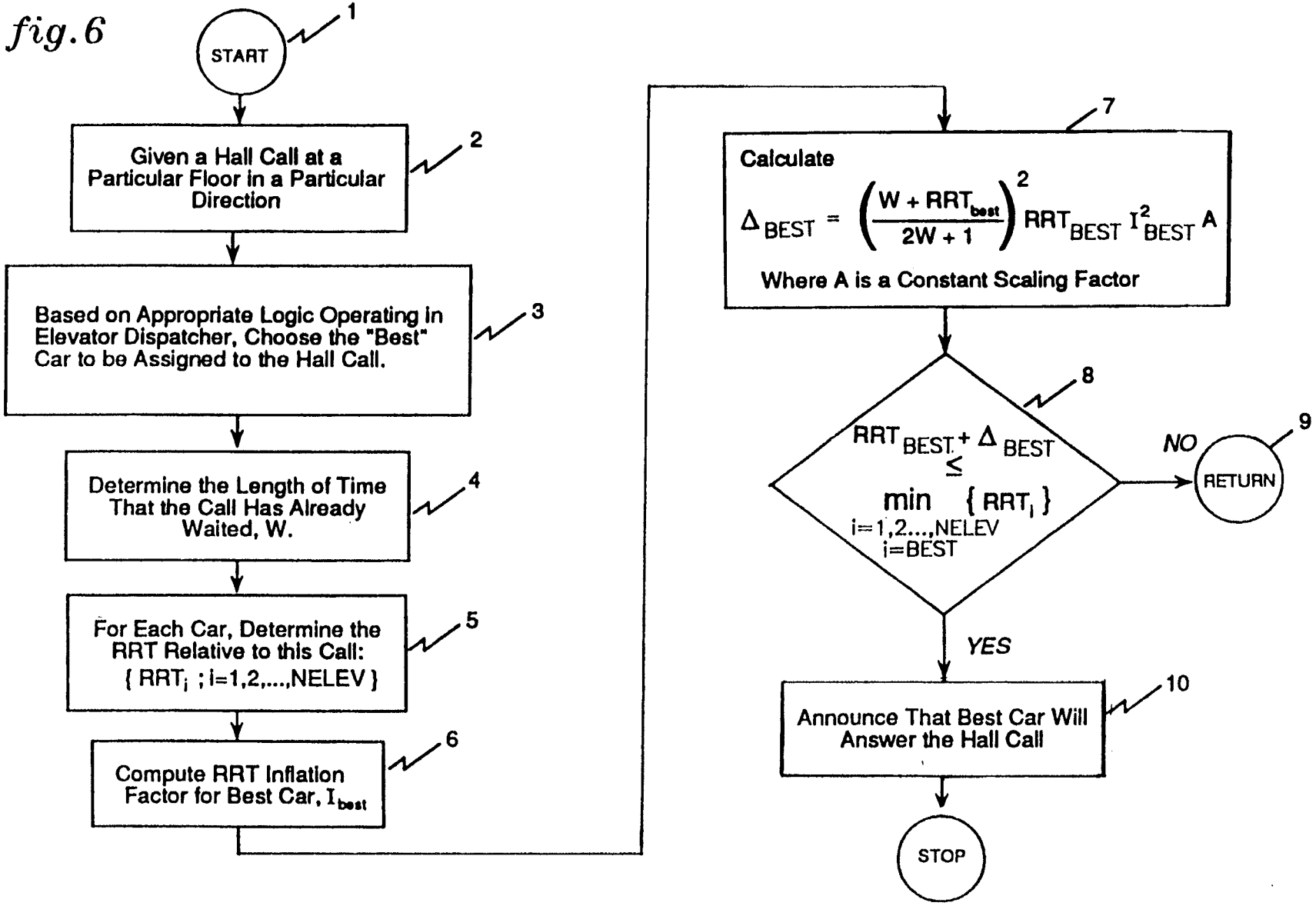
FIG. 6 is a flow chart for implementing an early car announcement (ECA).

The FIG. 5*a* serves to motivate the general idea of the invention. The equations (1) and (2) and the flow chart of FIG. 6 are more specific to the details of the invention. In the discussion of FIG. 5*a*, it is assumed that the "best" car is the car with the shortest RRT. The details of the invention remain unchanged if the choice of best car is based on logic other than shortest RRT.

The inset to FIG. 5*a* is the key to FIG. 5*a*. The expected remaining response time (RRT) of car #3 for servicing a hall call is shown. Since this is only an expectation, the actual remaining response time of, for example, car #3 if in fact it does serve the hall call, may be as long as the maximum remaining response time (maxRRT) or anywhere in between. The deviation from the expected remaining response is an RRT inflation (I).

Case A shows the expected RRTs and their associated maximums for all cars in a four car group. A hall call is registered. Dispatching logic determines car #1 to be the best car and assigns it to serve the hall call. The best car also happens to have the lowest RRT. In case A, there is no conflict for car #1; that is, the maximum RRT for car #1 is lower than the (minimum) expected RRT of any other car. In case B, there is some conflict between the best car (that is, car #1) and car #2 whose expected RRT is lower than the maximum RRT of car #1. There is yet more conflict in case C where the maximum RRT is not lower than the expected RRT of cars #2 and #3. Therefore, it is not at all clear that car #1 is the best car. According to ECA, no announcement is made until case A is met.

Figure 5B:
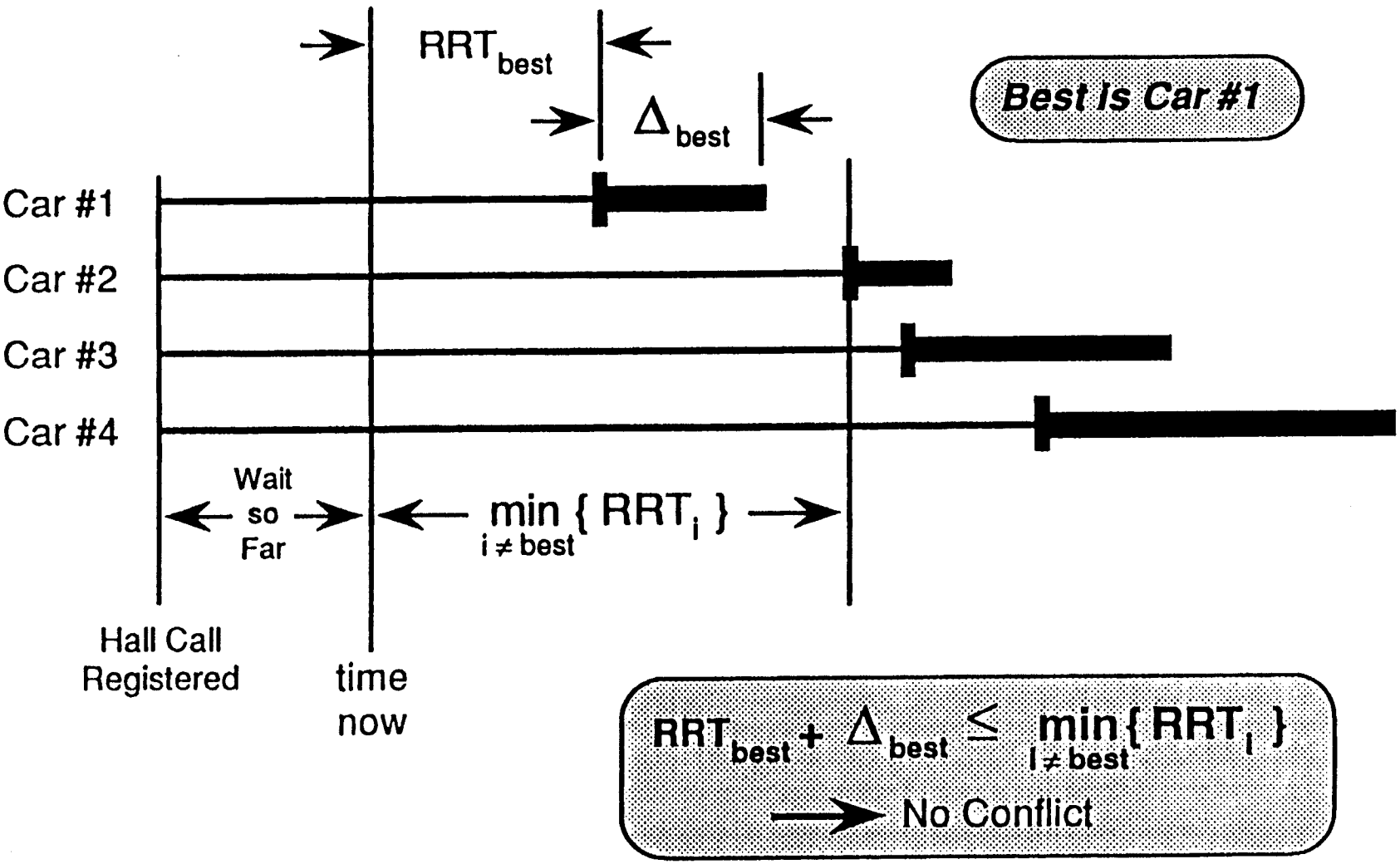

In the present ECA invention, a distinction must be maintained between the assignment of a car to a hall call and the announcement to the waiting passenger of the assigned car. At all times during the waiting period of a hall call, there will be a car assigned to the hall call. It is assumed that the car assignment logic is periodically activated, and, when desirable, the hall call may be reassigned to another car. Such reassignments cannot be observed by the waiting passenger until such time that the assignment is announced. After announcement, the hall call assignment is fixed and commonly not reassigned. FIG. 5*b* shows the circumstances under which a car announcement is made: In FIG. 5*b*, the condition $$RRT_{best} + \Delta_{best} \leqq \min_{i \neq best}(RRT_i)$$

is met.

FIG. 6 is a flow chart for implementing the present invention. After START,-step 1, a hall call is registered at a particular floor for a particular direction, step 2. Then, using appropriate elevator dispatcher logic, a "best" car is selected for possible assignment to the hall call, step 3. The appropriate dispatching logic may include RSR, ICA, or other dispatching logic. This best car is assigned to the hall call, and the announcement of this assignment might or might not be made, in accordance to steps 4–10 of this flow chart. Then, the wait-so-far of the hall call is determined, step 4. The remaining response times (RRTs) relative to this hall call are calculated for each car, step 5. In addition, the deviation from the expected RRT, that is, an RRT inflation is calculated for the best car. This RRT inflation factor is denoted $I_{best}$, step 6. To have a basis for determining whether the best car is clearly the best car (the assigned car) with little chance of conflict, the comfort factor is calculated, step 7.

$$\Delta_{best} = \left(\frac{W + RRT_{BEST}}{2W + 1}\right)^2 RRT_{best} I_{best}^2 A \tag{5}$$

Next, in step 8, $RRT_{best}$) is added to the comfort factor $\Delta_{best}$. The sum is compared to the minimum expected remaining response times of all the other cars in the group. If the sum is less than the remaining response times of all other cars in the group, then the announcement is made, by means of the hall fixture, that this best car will serve the hall call. If the sum is not less than the remaining response times of all other cars in the group, then return is entered and steps 2 through 8 are repeated at the next time for reevaluation of the car assignment. Steps 2 through 8 are therefore repeated until one car is clearly the best as determined by the decision at step 8, yes. Once the announcement is made and the assignment fixed, step 10, the present invention is executed. The convergence of $RRT_{best}$ upon zero as the best car nears the floor of the hall call ensures that step 10 is executed.

FIGS. 7, 8, 9, 10 are snapshots in time of the elevator system when operating according to the present invention.

Figure 7:
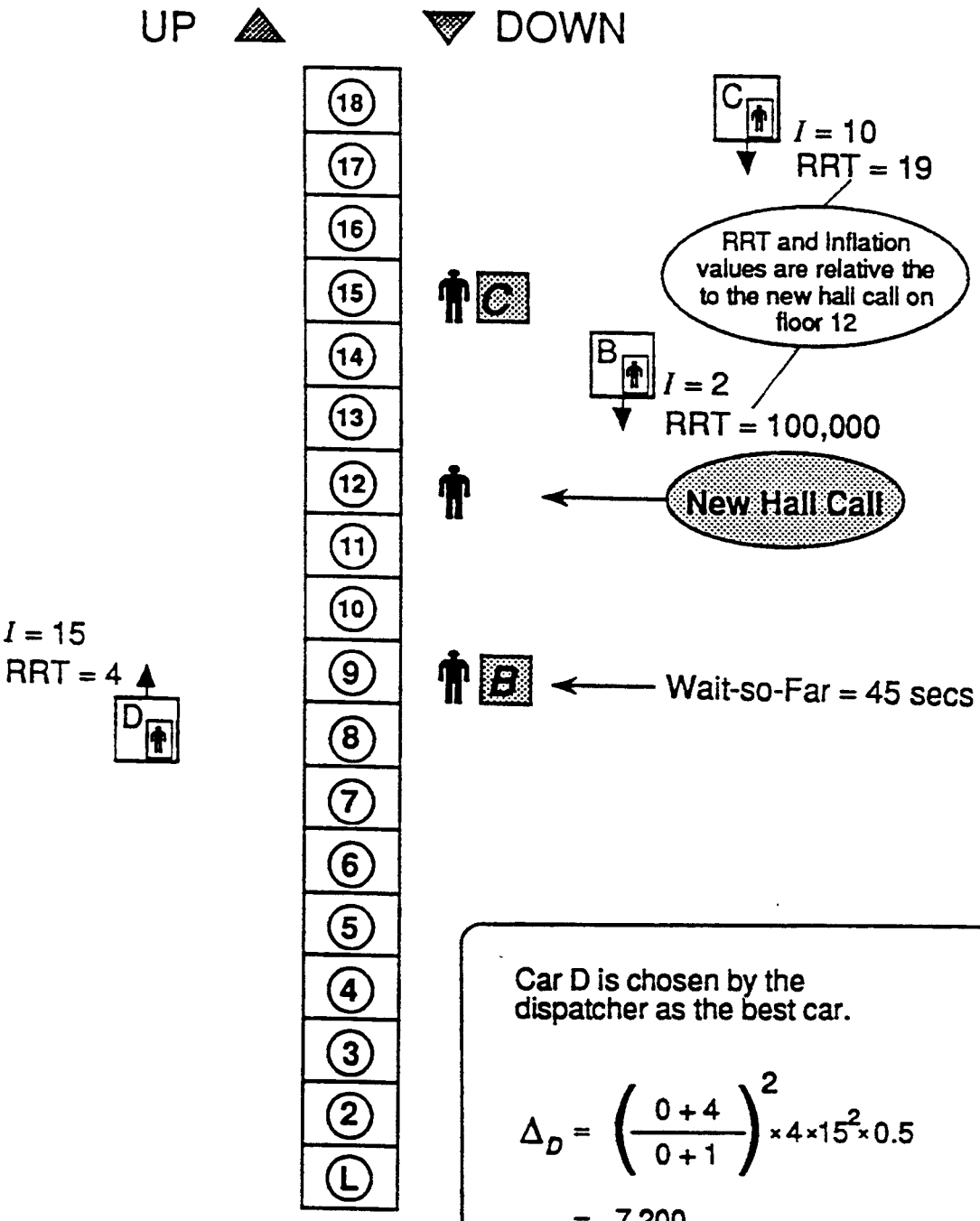
FIGS. 7, 8, 9, 10 are snapshots in time of the elevator system when operating according to the present invention.

In FIG. 7, the elevator system has announced that the down hall calls on floors 9 and 15 will be answered by cars B and C, respectively. This is depicted by the shaded B and C beside the waiting passenger at floors 9,15. A new down hall call is registered on floor 12. The RRT and RRT inflation (I) relative to the new hall call at floor 12 are shown next to each car. The dispatcher chooses car D for assignment to the new down hall call on floor 12. Car B was not chosen because the assignment to car B would cause the down hall call on floor 9 to wait an additional amount of time deemed to be excessive. The call at floor 9 is called an "elderly call" because the passenger has already been waiting so long. The RRT is set to a large number (100,000) to denote that car B is essentially ineligible.

At this time, a decision must be made as to whether or not to announce car D as the car assigned to serve the new down hall call at floor 12. Inset to FIG. 7 is the determination as to whether to make the announcement at this time. Car D is chosen by the dispatcher as the best car.

$$\Delta_D = \left(\frac{0 + 4}{0 + 1}\right)^2 \times 4 \times 15^2 \times 0.5 = 7{,}200 \tag{6}$$

$$RRT_D + \Delta_D \overset{?}{\leqq} \min\{RRT_B, RRT_C\} \tag{7}$$

$$4 + 7{,}200 \overset{?}{\leqq} \min\{100000, 10\} \tag{8}$$

Therefore, this is not the time to make the announcement.

Figure 8:
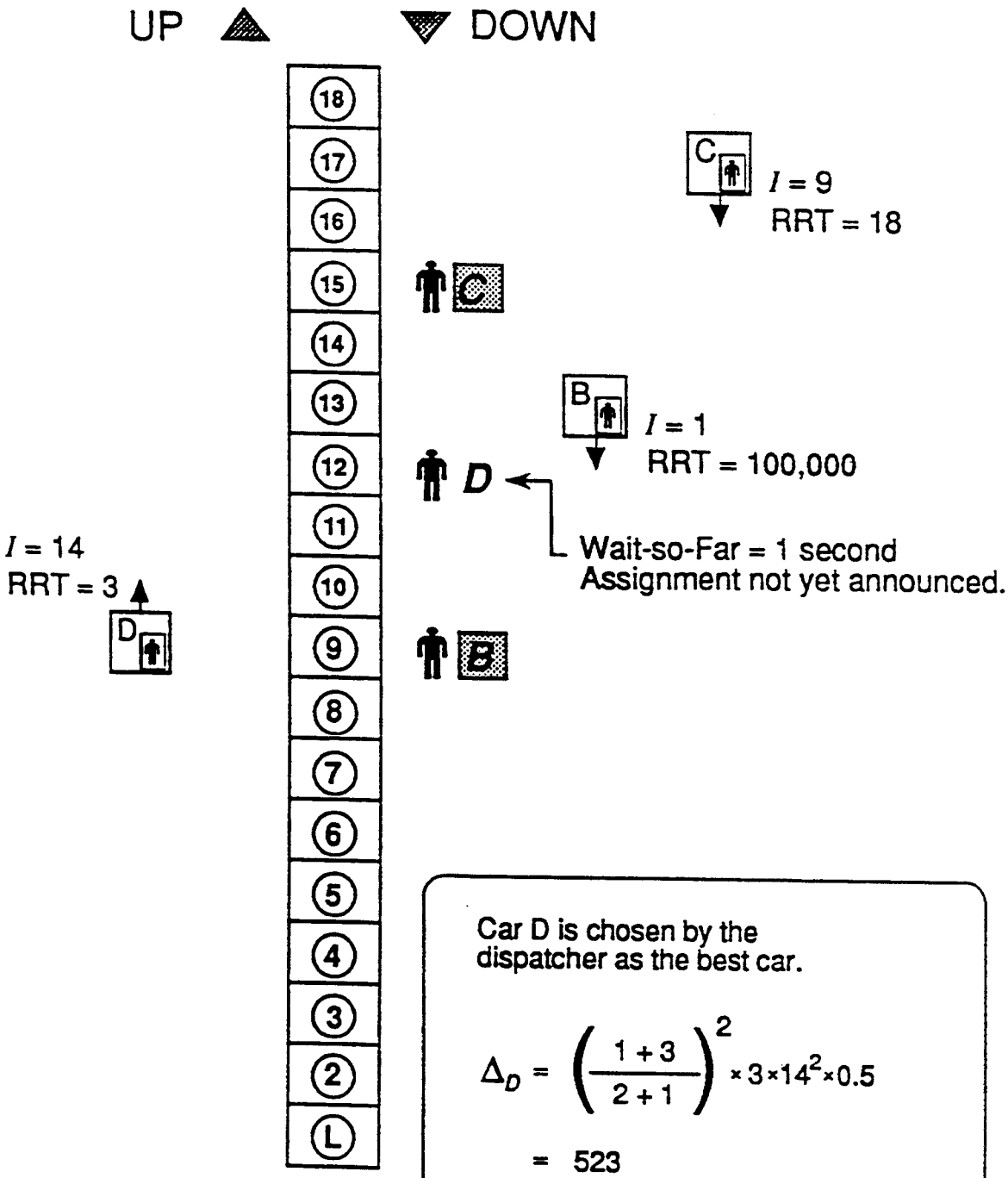

FIG. 8 is a snapshot taken immediately before the next reevaluation of the car assignment. It indicates that the down hall call on floor 12 is assigned to car D. However, the car is not yet announced, as indicated by the lack of shading of the assignment D. At the time of this reevaluation of the car assignment, car D is still the best car. Some car positions have changed. Therefore, RRT values and associated RRT inflation values have changed. The computations inset to FIG. 8 show that it is still too early to announce to the waiting passenger that car D will serve the hall call.

Figure 9:
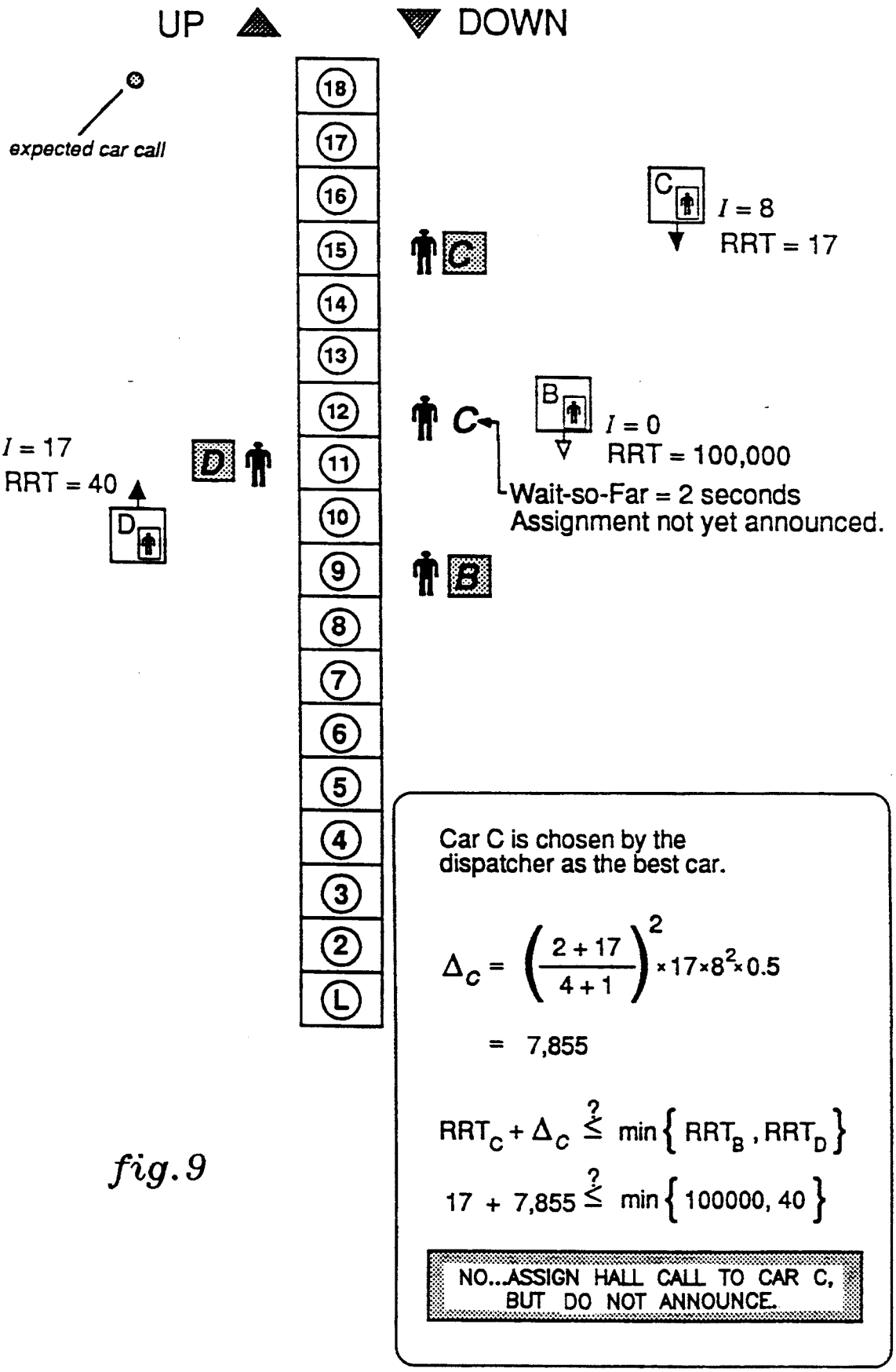

FIG. 9 is a snapshot taken before the assignment reevaluation of the car assignment at time=2 seconds after the floor 12 down hall call registration. Here, a new up hall call has been registered at floor 11 and assigned to car D. This up hall call assignment may generate a car call at or near the top of the building for car D. This will greatly increase the RRT of car D relative to the down hall call at floor 12. The dispatcher now chooses car C as the best car for the down hall call at floor 12. As shown by the calculations inset to FIG. 9, it is still too early to announce that car C will answer the hall call.

Figure 10:
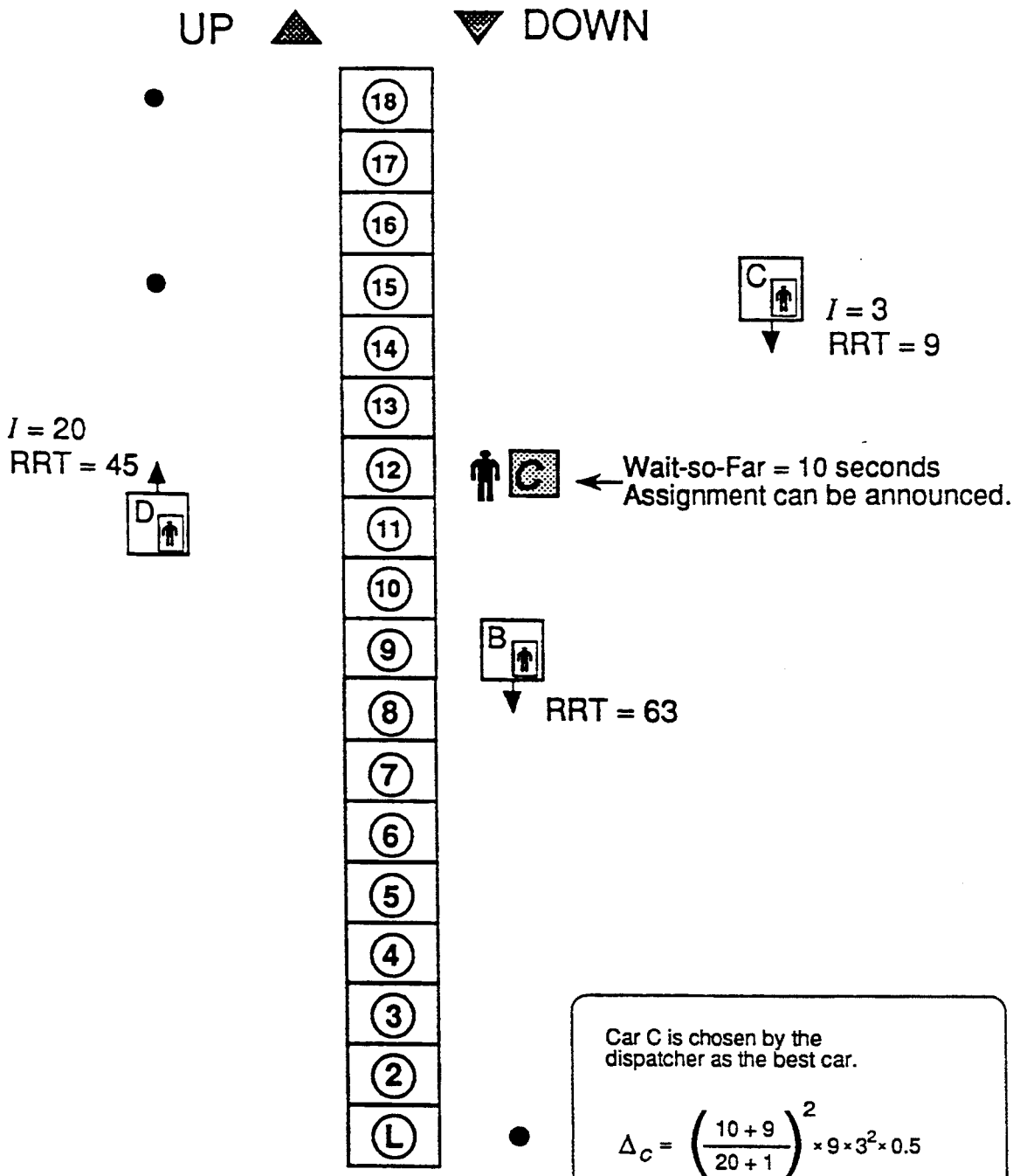

FIG. 10 is a snapshot taken 10 seconds after the floor 12 hall call registration at time=0. Car D's RRT makes it still unacceptable for serving the down hall call at floor 12. Car B has bypassed floor 12. Car C is the best car and as shown by the calculations in the inset of FIG. 10, the time for the announcement has come.

Figure 11:
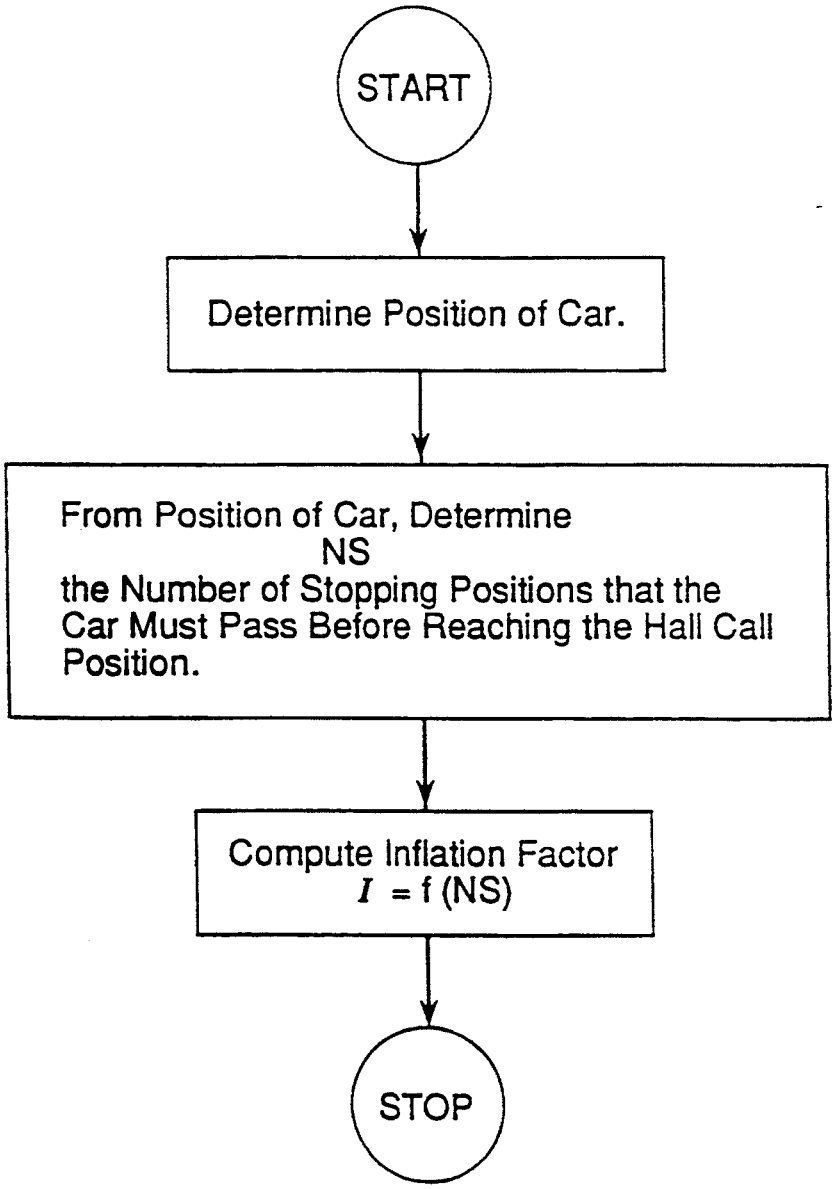
FIGS. 11 is a flow chart for providing an RRT inflation factor.

FIG. 11 is a flow chart for providing the RRT inflation factor (I). First, the position of the best car is determined. Next, from the position of the car, a variable NS indicative of the potential number of stopping positions is determined. Finally, the RRT inflation factor (I) is calculated as a function of NS, the number of stopping positions. This is not the only way that the RRT inflation factor can be calculated.

Figure 12:
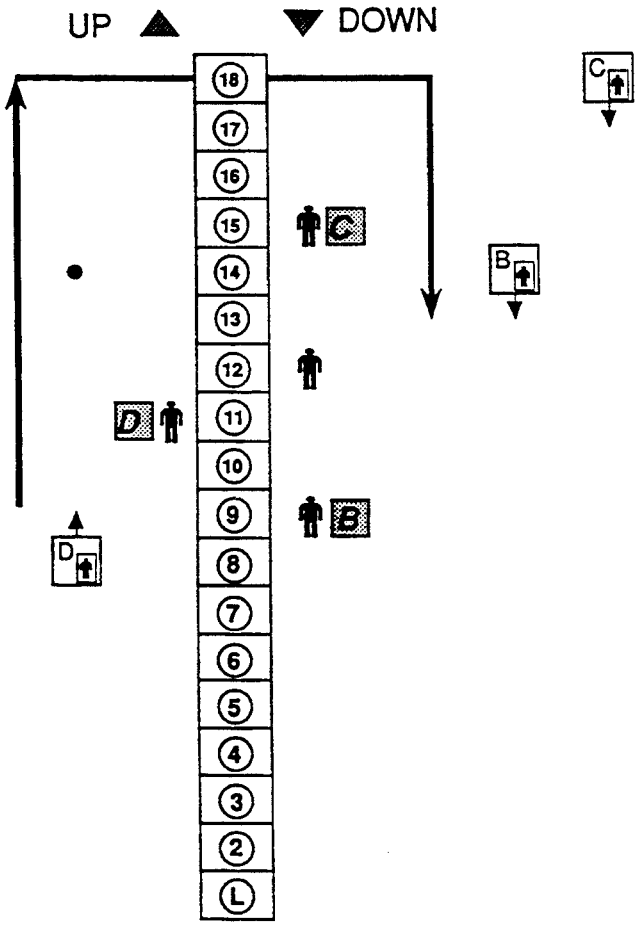
FIG. 12 is a snapshot of the elevator system for illustrating the RRT inflation factor.
Figure 10:
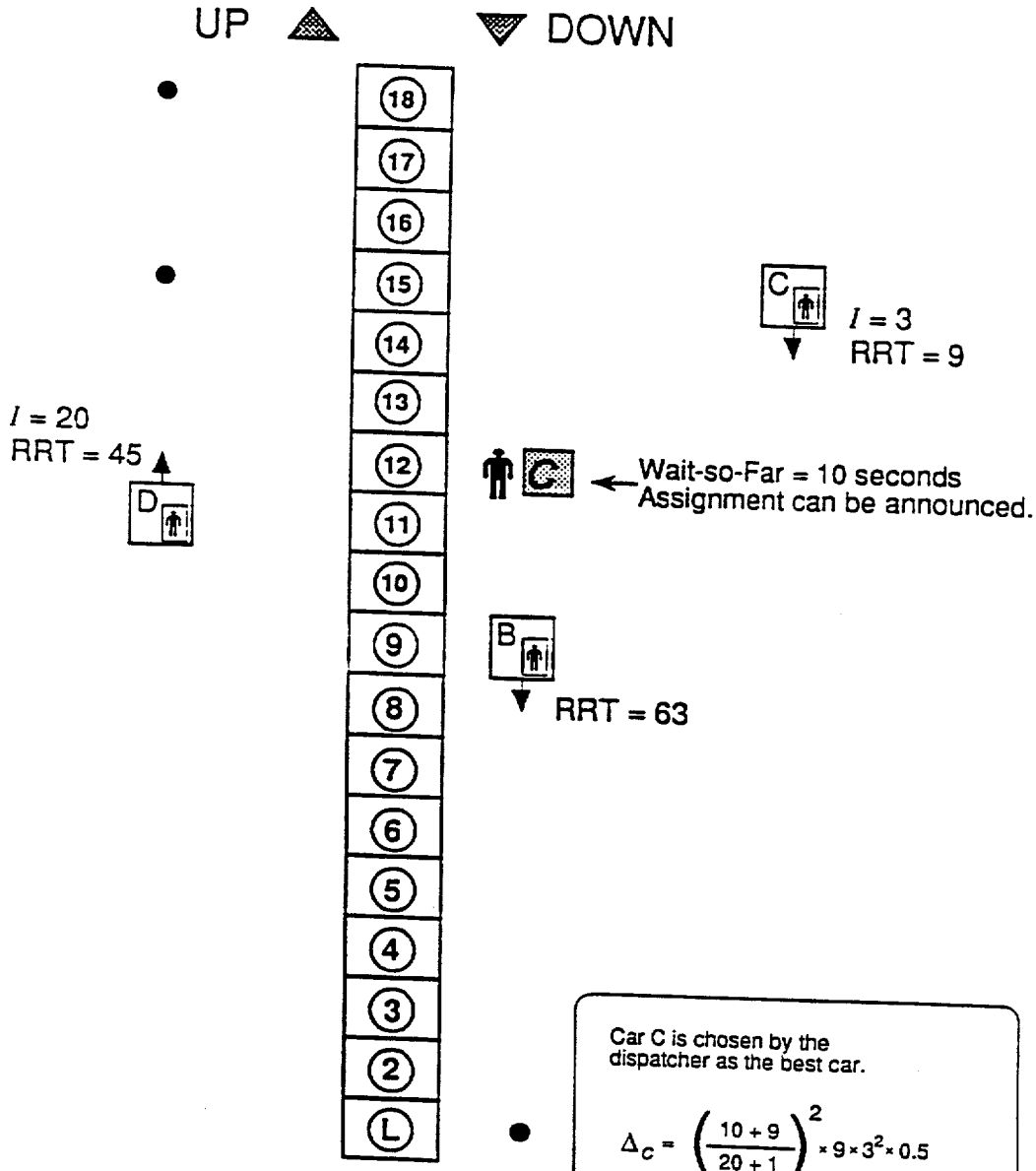

FIG. 12 is a snapshot of the elevator system for illustrating the RRT inflation factor (I). The RRT inflation factor (I) measures the extent to which the current estimate of RRT might become inflated due to future unknown stops. Future stops will occur along a path that car D will travel to reach the new down hall call on floor 12. The longest path that the car might take is called the maximum path, and is indicated by the thick line. Potential stopping positions are floors 9–18 in the up direction and floors 17–13 in the down direction for a total of 15 stops. For each potential stopping position on the maximum path, one inflation point is considered in the I determination if no car is committed to stop due to a car call or assigned hall call. Add 4 more points if the car whose I is being calculated is committed to a stop. The reason for adding the 1 point is that if no other car has an assignment to stop, then should any hall calls be registered there is a chance that car D will have to take it. A value of 0 is assigned to floors where another car will stop since if any hall calls are registered in the future they may be answered by the other car. The table in FIG. 12 shows the RRT inflation factor for car D. With respect to the floor 12 down hall call, the RRT inflation factor is 22.

Various changes may be made to the above description without departing from the spirit and scope of the invention. For example, RRT may be defined to include the statistical variance of an estimation of the amount of time required for an elevator to reach the floor at which the hall call is registered, given the car calls and hall calls to which the elevator car is committed.

We claim:

1. A method of announcing to a waiting passenger which elevator car of a plurality of elevator cars will serve a hall call registered by said waiting passenger, comprising:

temporarily assigning a car to answer said hall call, said car being the assigned car;

measuring the remaining response time (RRT) for each car of said plurality, in response to registration of the hall call, wherein said RRT for a car is an estimation of the time required for an elevator to reach the commitment point of the floor at which the hall call is registered, given the car calls and hall calls to which the car is committed;

providing an RRT inflation factor of said assigned car as a function of the number of potential stops for the assigned car between the position of the assigned car at a given time and the floor of hall call registration, indicative of the likelihood that the RRT of said assigned car will become inflated because of the assignment of the car assigned to the registered hall call to future hall calls or car calls;

committing the assigned car to service said hall call and announcing the assignment to the waiting passenger when the assigned car has its RRT at least a calculated number of seconds lower than the car with the next lowest RRT, wherein said number of seconds is selected as a function of the RRT inflation factor.

2. The method of claim 1 wherein said number of seconds is provided in response to the amount of time said waiting passenger has waited since registration of the hall call, the RRT inflation factor of the assigned car and the RRT of the assigned car.

3. The method of claim 1 wherein said number of seconds is provided by:

$$\Delta_{best} = \frac{W + RRT_{best}}{2W + 1} RRT_{best} I^2_{best} A$$

W is the time waited so far by the passenger who registered the hall call.

RRT is the current RRT, remaining response time.

I is the RRT Inflation, which is an amount of deviation from the minimum expected remaining response time of the assigned car.

A is a constant scaling factor, large values of A cause the system to make later announcements, while smaller values encourage earlier announcements.

* * * * *

UNITED STATES PATENT AND TRADEMARK OFFICE

CERTIFICATE OF CORRECTION

PATENT NO. : 5,338,904

DATED : August 16, 1994

INVENTOR(S) : Bruce A. Powell and David J. Sirag, Jr.

It is certified that error appears in the above-identified patent and that said Letters Patent is hereby corrected as shown below:

Column 3, line 18: Change "charts" to —chart—.

Column 3, line 28: Change "Figs. 11" to —Fig. 11—.

Column 3, line 48: after "until" delete "the".

Column 4, line 40: Change "RRt" to —RRT—.

Column 6, line 1: Move "Equation (5)" to Column 5, line 67, after the word "factor".

Column 6, line 2, after "$RRT_{best}$" delete ")".

UNITED STATES PATENT AND TRADEMARK OFFICE

CERTIFICATE OF CORRECTION

PATENT NO. : 5,338,904

DATED : August 16, 1994

INVENTOR(S) : Bruce A. Powell and David J. Sirag, Jr.

It is certified that error appears in the above-indentified patent and that said Letters Patent is hereby corrected as shown below:

Delete drawing sheet 11, and substitute therefor the drawing sheet, consisting of figure 10, as shown on the attached page.

Signed and Sealed this

Fourteenth Day of March, 1995

*Attest:*

*Attesting Officer*

BRUCE LEHMAN

*Commissioner of Patents and Trademarks*

Car C is chosen by the dispatcher as the best car.

$$\Delta_C = \left(\frac{10+9}{20+1}\right)^2 \times 9 \times 3^2 \times 0.5$$

$$= 33$$

$$RRT_C + \Delta_C \overset{?}{\leq} \min\{RRT_B, RRT_D\}$$

$$9 + 33 \overset{?}{\leq} \min\{63, 45\}$$

YES ... ASSIGN HALL CALL TO CAR C, AND ANNOUNCE.